US010475422B1

(12) United States Patent
Hirayama

(10) Patent No.: US 10,475,422 B1
(45) Date of Patent: Nov. 12, 2019

(54) INTONATION TOOL FOR FINE TUNING BRIDGE

(71) Applicant: Meister Works, Inc., Fujiedashi, Shizuoka (JP)

(72) Inventor: Shinjiro Hirayama, Aichi (JP)

(73) Assignee: Meister Works, Inc., Fujiedashi, Shizuoka (JP)

( * ) Notice: Subject to any disclaimer, the term of this patent is extended or adjusted under 35 U.S.C. 154(b) by 0 days.

(21) Appl. No.: 16/261,570

(22) Filed: Jan. 30, 2019

(51) Int. Cl.
*G10D 3/14* (2006.01)
*G10D 3/04* (2006.01)

(52) U.S. Cl.
CPC ..... *G10D 3/14* (2013.01); *G10D 3/04* (2013.01)

(58) Field of Classification Search
CPC ..... G10D 3/14; G10D 3/04
See application file for complete search history.

(56) References Cited

U.S. PATENT DOCUMENTS 4,171,661 A 10/1979 Rose
4,497,236 A 2/1985 Rose
4,779,506 A * 10/1988 Takeuti ..... G10D 3/14 84/267

* cited by examiner

*Primary Examiner* — Kimberly R Lockett
(74) *Attorney, Agent, or Firm* — Yokoi & Co., U.S.A.; Toshiyuki Yokoi

(57) ABSTRACT

The angle adjustment structure of intonation tools for guitar bridges which have fine tuners. There are intonation tools for guitar bridges which have fine tuners like U.S. Pat. No. 4,497,236, but these bridges have some patterns of baseplate portion, so it is difficult to match to some patterns of baseplate portion by one intonation tool. This invention makes the intonation tool capable of matching to some patterns of baseplate portion by giving angle adjustment structure.

3 Claims, 10 Drawing Sheets

FIG.4D (A-A)

Related Art

INTONATION TOOL FOR FINE TUNING BRIDGE

CROSS-REFERENCES TO RELATED APPLICATIONS

There are no patent applications filed by me which are related to this patent application.

BACKGROUND OF THE INVENTION

1. Field of the Invention

The present invention relates to an intonation tool for a fine tuning bridge of an electric guitar.

2. Description of Related Art

In the field of stringed instruments, especially electric guitars, there is a type of system called double locking tremolo system, U.S. Pat. No. 4,171,661. This is the means to maximize tuning stability by locking string at bridge and nut part.

After locking both side of strings, a problem that strings cannot be tuned by machinehead occurs.

To solve this problem, the general double locking bridge has fine tuners as shown by U.S. Pat. No. 4,497,236.

This apparatus shows that a main saddle which has a part in which a string is locked is pivotally connected to sub saddle by pin, and the main saddle can be adjusted the rotate amount by fine tuning screws which are screwed to baseplate of bridge, so it allows to adjust tuning after strings locked. And this is called "fine tuning".

Generally, the string slot curve of main saddle is designed as concentric with pin, so the length of string vibration is not changed by fine tuning. After string inserted into main saddle, the string is locked by lock pad which is tightened by string lock screw. In this bridge with fine tuning system of U.S. Pat. No. 4,497,236, There is a big problem of intonation adjustment.

Intonation adjustment is to adjust the location of saddle unit toward string directions because the real vibration length is changed by string thickness. But for this bridge with fine tuning system of U.S. Pat. No. 4,497,236, it is difficult to adjust intonation location precisely because when the saddle lock screw is loosened, the saddle unit moves toward neck headstock by the string tension. So general users at first loosen string tension enough so as not to move saddle unit and loosen the saddle fixation screw and put the saddle unit to assumed best location by hand. After that, tighten the saddle fixation screw again. By this way, of course, it is difficult to put saddle unit to precise location.

So, in the market, there are intonation tools by which intonation adjustment can be done in state of string tensioned. By using this, the saddle unit doesn't move after loosening saddle fixation screw and users can adjust saddle unit location precisely by its screw structure.

But on the other hand, there are several portion types of the bridge baseplate with fine tuning system of U.S. Pat. No. 4,497,236. And it is impossible to do intonation adjustment to them by one intonation tool. So, there is a problem to be solved to adjust several portion types of bridge baseplate by one intonation tool.

BRIEF SUMMARY OF THE INVENTION

The apparatus, which has a leg part to be hooked on the bridge baseplate part at which fine tuning screws are screwed and this leg part is a divided part from intonation tool's base part.

By the angle adjustment structure between leg part and base part, it becomes possible to adjust intonation on several shape types of bridge by one intonation tools.

BRIEF DESCRIPTION OF THE DRAWINGS

FIG. 4D shows a cross-sectional view of the saddle unit.

DETAILED DESCRIPTION OF THE INVENTION

Figure 1:
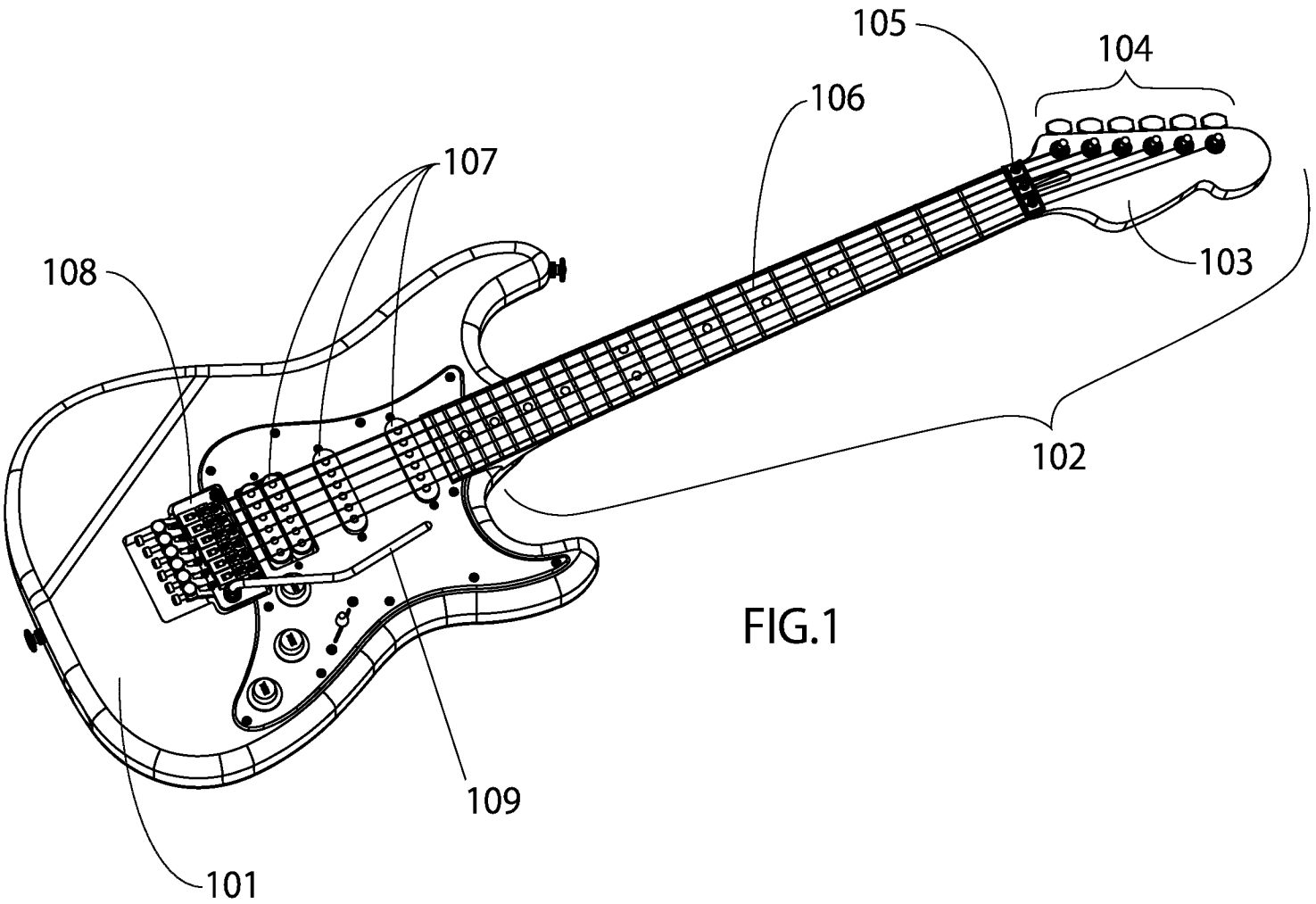
FIG. 1 shows a perspective view of an electric guitar.
Figure 2:
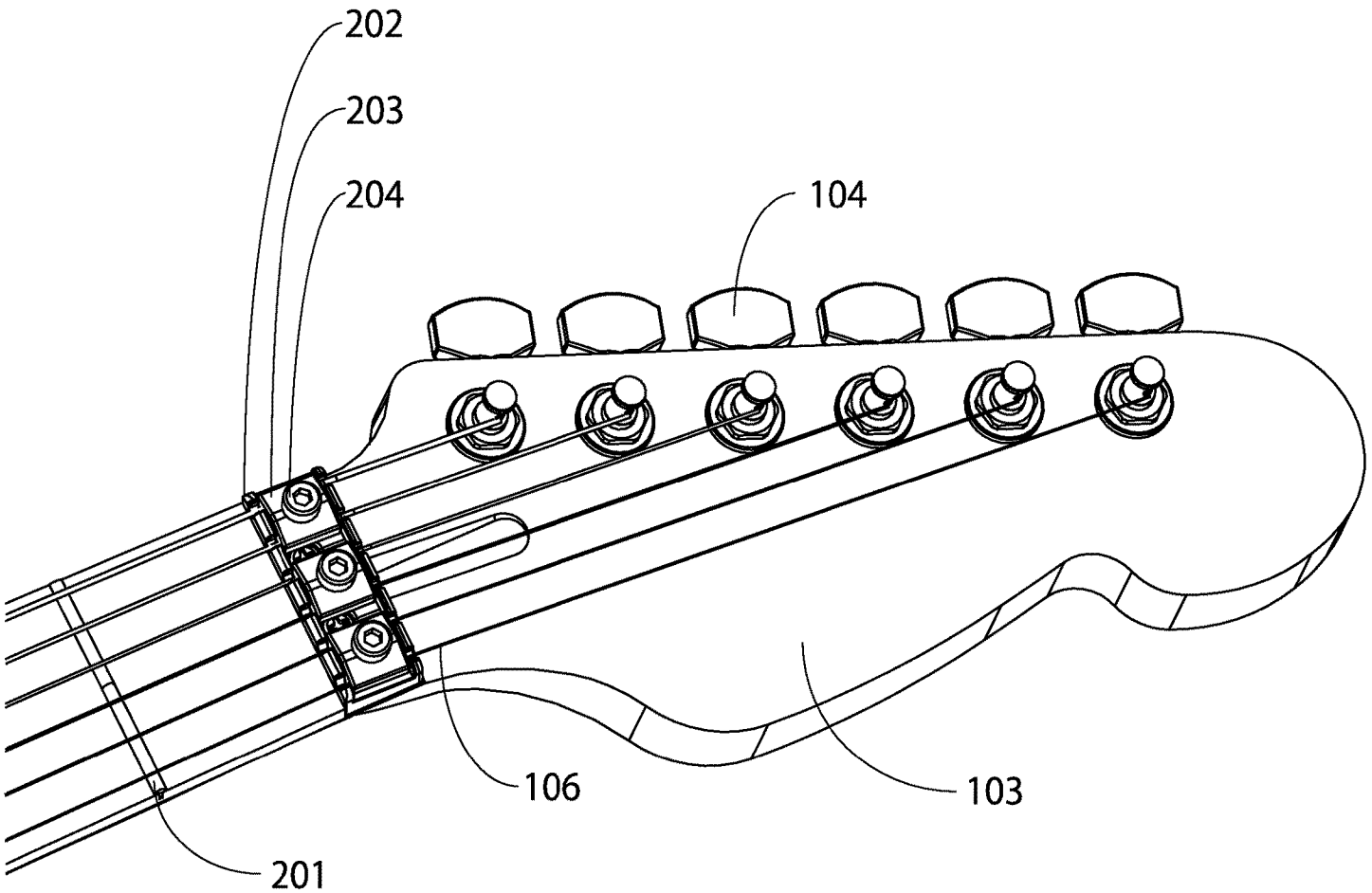
FIG. 2 shows an enlarged perspective view of a headstock part.

FIG. 1 shows an overall view of an electric guitar which has a general structure of double locking system of U.S. Pat. No. 4,171,661 and fine tuning system of U.S. Pat. No. 4,497,236. This is a type of guitar generally called "Double locking guitar", in which strings are locked at bridge end and nut end. By this way, the tuning stability after bridge 108 tremolo motion by tremolo arm 109 is maximized.

At headstock 103 of the neck 102 which is connected to a body 101, machineheads 104 are mounted and string tension can be tuned by them. One string end 106 are hooked at machinehead 104, and another string end is locked on a main saddle 302 of bridge 108, the sounds are generated by strings 106 vibrating between saddles 302 and nut 105, and the sounds are converted from physical signal to electric signal by magnetic pickups 107.

The bridge 108 are connected to springs at body back and the springs are connected to the body 101. The bridge 108 has a tremolo arm to rock the bridge backward and forward. By rocking tremolo arm 109, the bridge moves pivotally up and down around stud bolt 310 as fulcrum point. By this motion, the string pitch varies higher and lower from original pitch. To minimize going out of tune after bridge tremolo motion, the strings 106 are locked with metal nut 202 and metal pad 203 by tightening lock screw 204 after tuned by machineheads 104.

Figure 3:
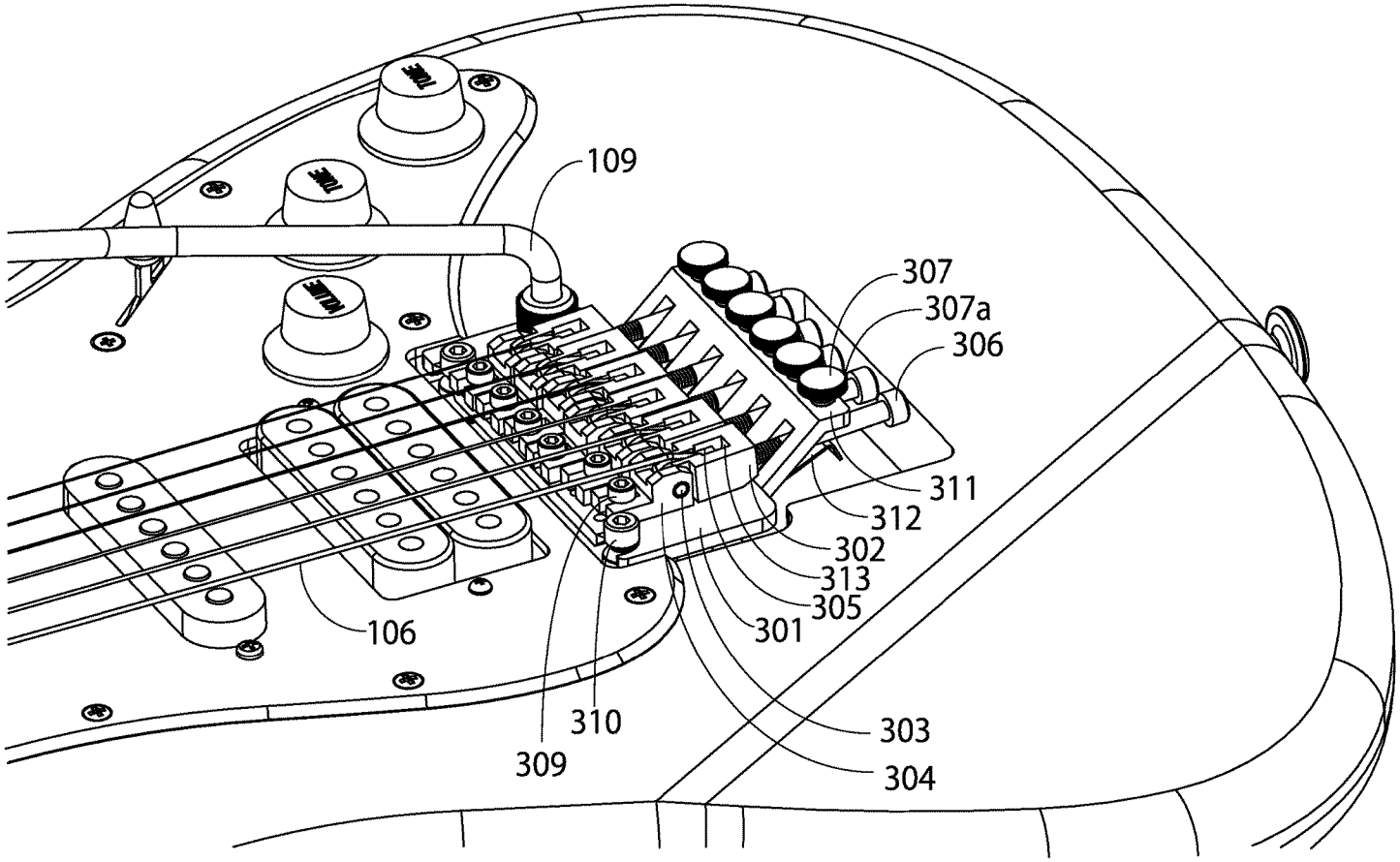
FIG. 3 shows an enlarged perspective view of a body part.
Figure 4B:
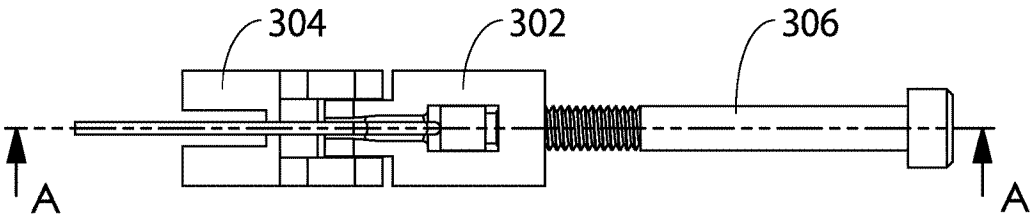
FIG. 4B shows a plan view of the saddle unit.
Figure 4C:
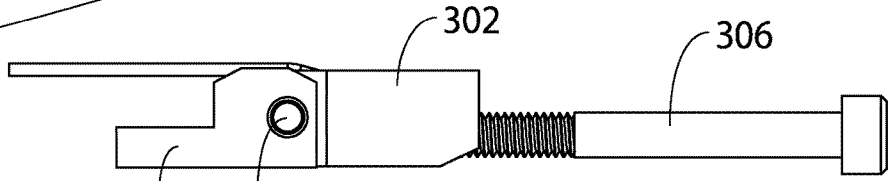
FIG. 4C shows a side view of the saddle unit.
Figure 4A:
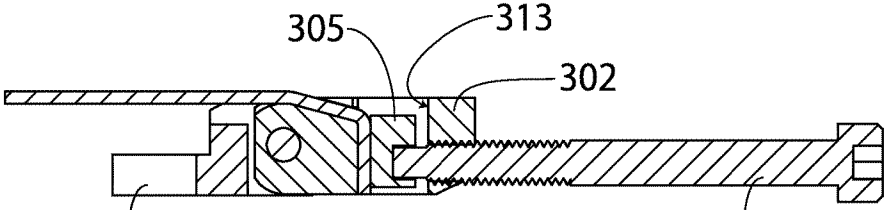
FIG. 4A shows a perspective view of a saddle unit.
Figure 4A:
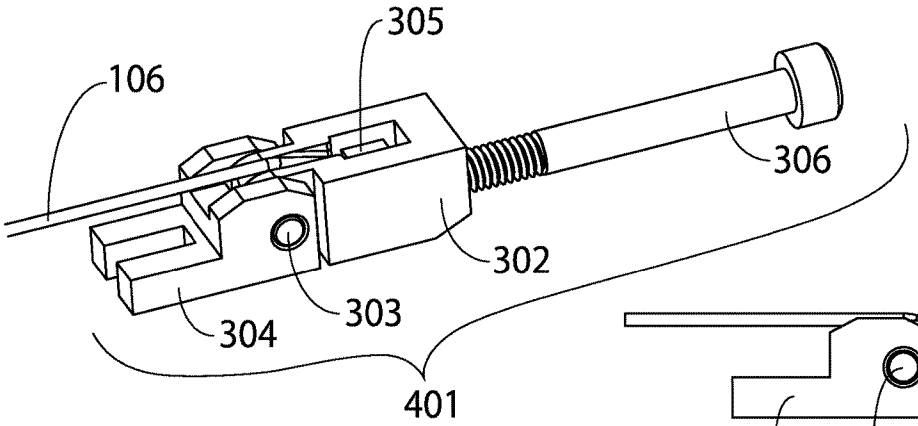
Figure 5B:
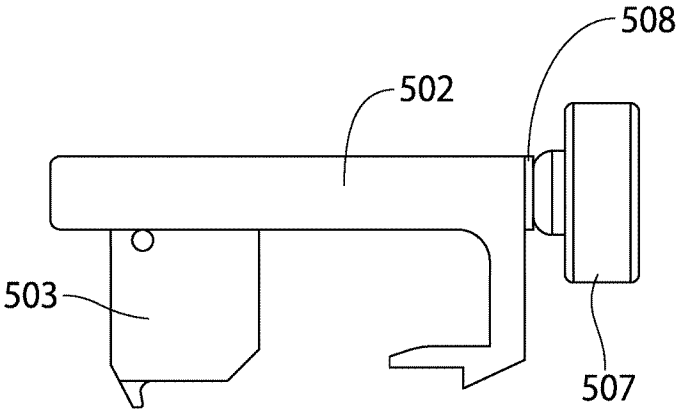
FIG. 5B shows a side view of the conventional intonation tool.
Figure 5C:
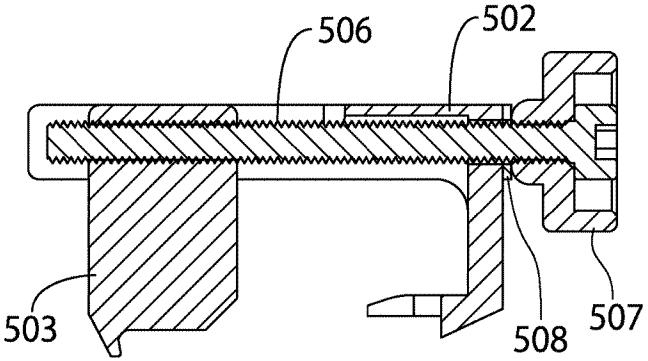
FIG. 5C shows a cross-sectional view of the conventional intonation tool.
Figure 5A:
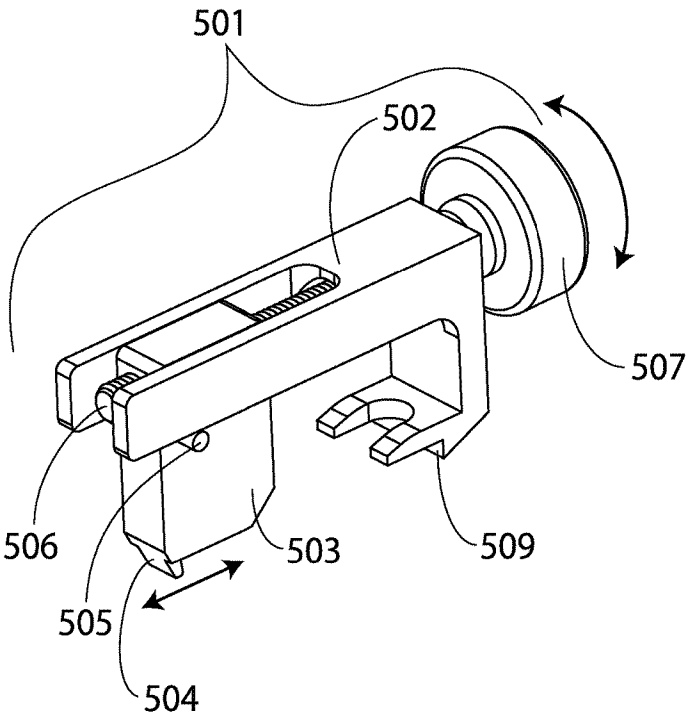
FIG. 5A shows a perspective view of the conventional intonation tool.

When the both sides of strings are locked, naturally, there is a problem that it is impossible to tune strings any more. If strings go out of tune even slightly, players must loosen lock screw 204 again, and tune and tighten again. It is very frustrating players. To solve this, general double locking bridge has a structure called fine tuners which is disclosed by U.S. Pat. No. 4,497,236. (FIG. 3)

A main saddle 302 is connected to a sub saddle 304 by a pin 303, so main saddle 302 can rotate around the pin 303. And the rotation angle is adjusted by fine tuning screw 307 which is screwed on the part which is elongated from baseplate, so even after locking both sides of strings 106, string tension can be tuned by rotating fine tuning screw 307, even though the tuning range is comparatively small. This structure is called "fine tuners" and to adjust by rotating fine tuning screw 307 is called "fine tuning".

Generally, the critical contact point curve 314 of main saddle 302 is designed to have the same center point as a pin 303, so the practical string length does not change by fine tuning. The strings 106 are inserted into the main saddle 302 and then locked with lock pad 305 by tightening lock screw 306.

In this type of bridge 108 which has fine tuners of U.S. Pat. No. 4,497,236, there is a problem, it is intonation adjustment. Intonation adjustment is to correct saddle unit 401 location toward string directions because the real vibration lengths of strings are changed by string thickness. But generally, it is difficult to do intonation adjustment for the bridge of U.S. Pat. No. 4,497,236 in strings tensioned state.

Because when the saddle fixation screw 309 is loosened, the saddle unit 401 will move toward the headstock 103 because the saddle unit 401 is pulled by string tension. So in the market, there are intonation tools 501. By this tool 501, the saddle unit 401 location is not changed even if the saddle fixation screw 309 is loosened, and the saddle unit 401 location can be adjusted precisely by screw structure.

The explanation of this intonation tool 501 is below. This intonation tool 501 has a leg part 509 which catches the part 311 of U.S. Pat. No. 4,497,236 bridge baseplate, and fine tuning screw 307 is screwed near of the part 311. By rotating thumb knob 507 which is integrated with adjustment screw 506, the claw part 503 which has claw portion 504 to be hooked into the part 313 of main saddle 302 is moved toward string directions. The claw part 503 has projections 505 which project from both sides of the claw part 503, and these projections 505 restrict the claw part 503 motion toward upper side. And there is a plastic washer 508 between the base 502 and the thumb knob 507 to reduce rotation torque of thumb knob 507.

Figure 6:
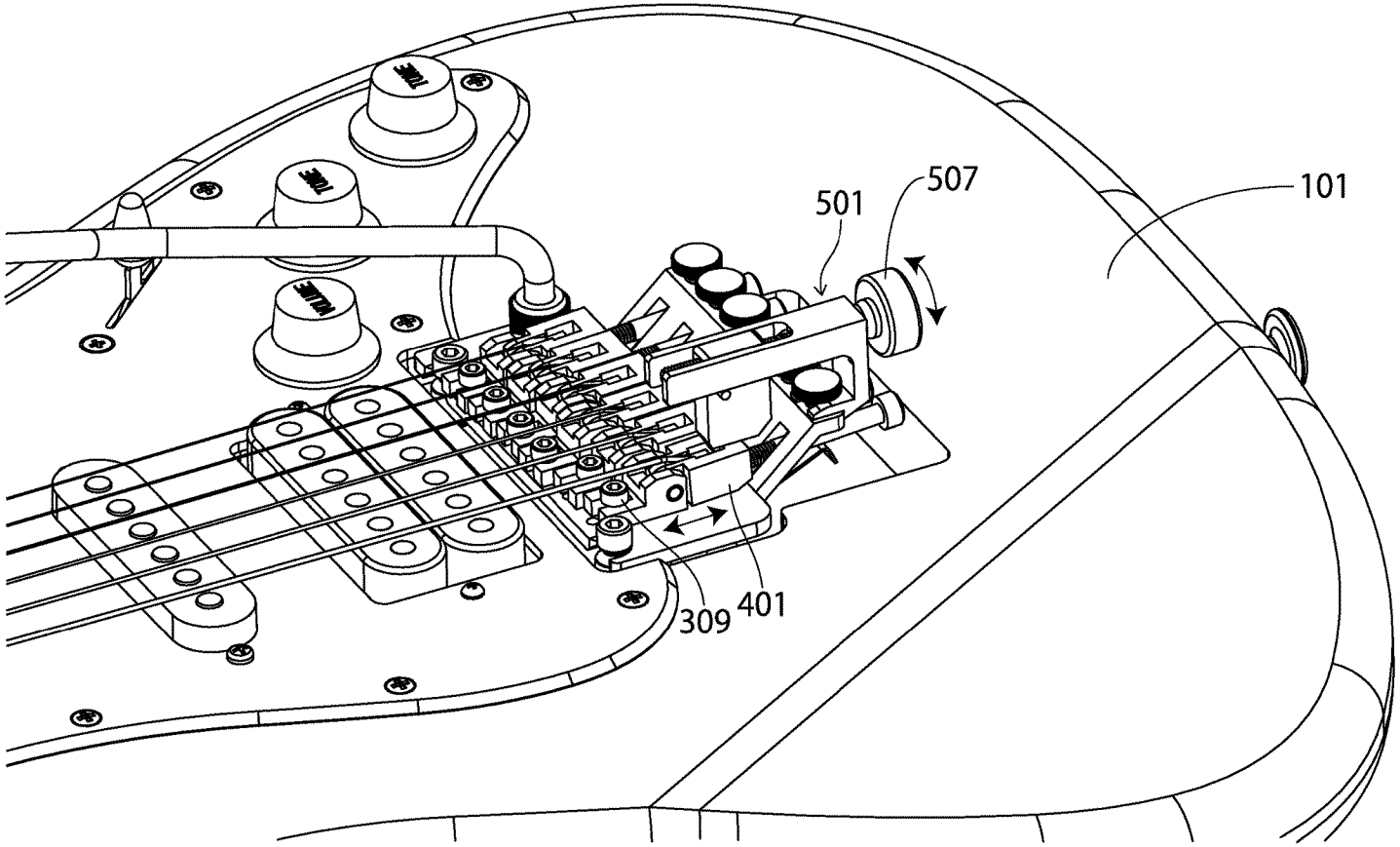
FIG.6 Related Art
FIG. 6 shows an enlarged perspective view of the body part to which the conventional intonation tool is attached.

Concrete intonation adjustment by an intonation tool 501 is below. At first, install the intonation tool 501 on the guitar bridge 108 in state of strings tuned. And adjust thumb knob 507 so as not to have any wobbles. Next, loosen the saddle fixation screw 309, and adjust the location of saddle unit 401 backward or toward by rotating thumb knob. (FIG. 6) When the saddle unit 401 is adjusted at right position, tighten the saddle fixation screw 309 again. And take off the intonation tool 501 from the bridge 108, then the intonation adjustment is completed.

By using this intonation tool 501, it is possible to adjust intonation location in state of string tuned, so it is far more precise than the way that loosen string tension and adjust the saddle unit 401 location by hand and tighten saddle fixation screw 309 again.

On the other hand, the portion of U.S. Pat. No. 4,497,236 bridge varies by manufacturers like FIG. 7A, FIG. 7B, so it was impossible to adapt to several makers' bridge by one intonation tool 501.

This invention discloses the way that one intonation tool can adapt to several portion type of U.S. Pat. No. 4,497,236 bridges. This invention's intonation tool 801 has a leg part 804 which catches the part 311 of U.S. Pat. No. 4,497,236 bridge baseplate, and this leg part 804 is composed as another part from base part 802. The leg part 804 and base part 802 is connected by rotating structure which has also adjustment structure of rotation angle. By these components, it becomes possible to adjust leg part 804 angle toward the base part 802, and adapt to several portion types of U.S. Pat. No. 4,497,236 bridges with fine tuners by one intonation tool.

The embodiment of this invention is below. This invention's intonation tool 801 for U.S. Pat. No. 4,497,236 bridges with fine tuners has a leg part 804 which is hooked the part 311 of bridge baseplate, and this leg part 804 is composed as another part from base part 802. The leg part 804 and base part 802 is connected by pin 803. So, the leg part 804 can rotate around the pin 803.

And angle adjustment screw 805 is screwed at elongated part 811 of base part 802. By rotating this angle adjustment screw 805, the leg part 804 angle toward the base part 802 is decided. By arranging the center point of this pivotal motion properly, it becomes possible to adapt to several portion types of U.S. Pat. No. 4,497,236 bridges by one intonation tool.

Figure 7B:
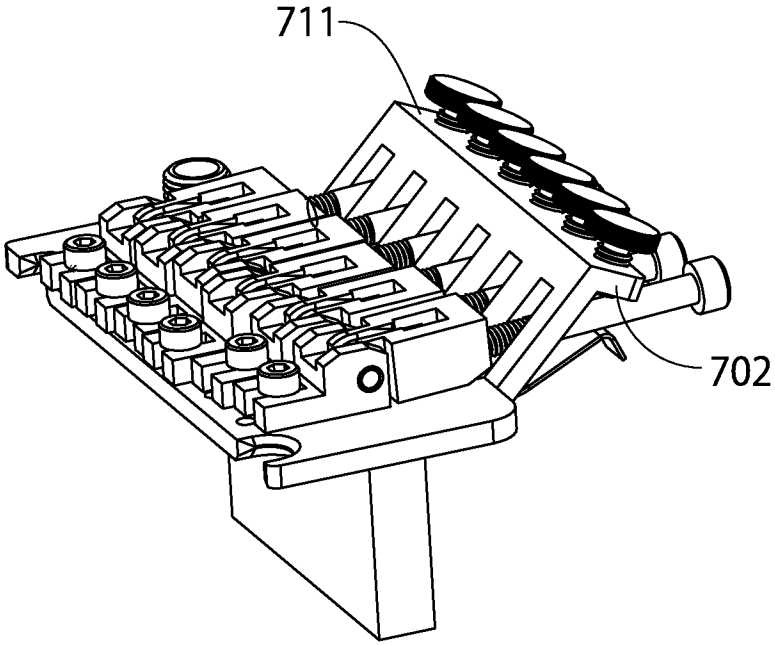
FIG. 7B shows a perspective view of a fine tuning bridge of the second type.
Figure 7A:
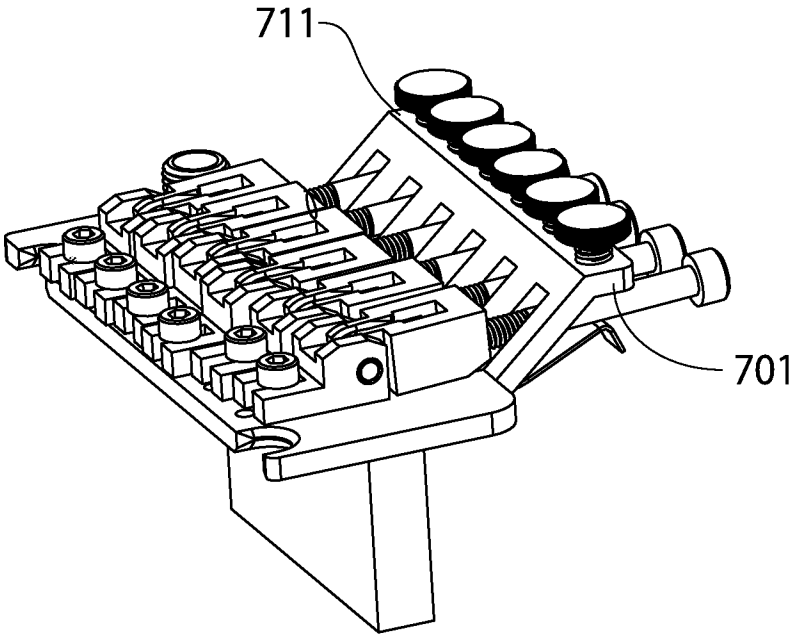
FIG. 7A shows a perspective view of a fine tuning bridge of the first type.

FIG. 7A is a perspective view of the fine tuning bridge of the first type. FIG. 7B is a perspective view of a fine tuning bridge of the second type.

In a fine tuning bridge 701 of the first type, an engagement part 711 for the fine tuning bolts has a plate shape and is nearly parallel with the not illustrated body. On the other hand, in a fine tuning bridge 702 of the second type, the engagement part 711 for the fine tuning bolts has a plate shape and is inclined with respect to the not illustrated body so as to approach the body of the electric guitar toward the opposite side of the strings. In the conventional intonation tool 501, the leg part 509, which is configured to be hooked to the engagement part 711 for the fine tuning bolts, is fixed to the base 502 at a predetermined angle Therefore, the conventional intonation tool 501 cannot be hooked to the engagement part 711 for the fine tuning bolts when the engagement part 711 is inclined with respect to the body as shown in the fine tuning bridge 702 of the second type, although it can be hooked to the engagement part 711 for the fine tuning bolts when the engagement part 711 is parallel with the body as shown in the fine tuning bridge 701 of the first type. Namely, the conventional intonation tool 501 cannot be attached to the fine tuning bridge 702 of the second type.

Figure 8B:
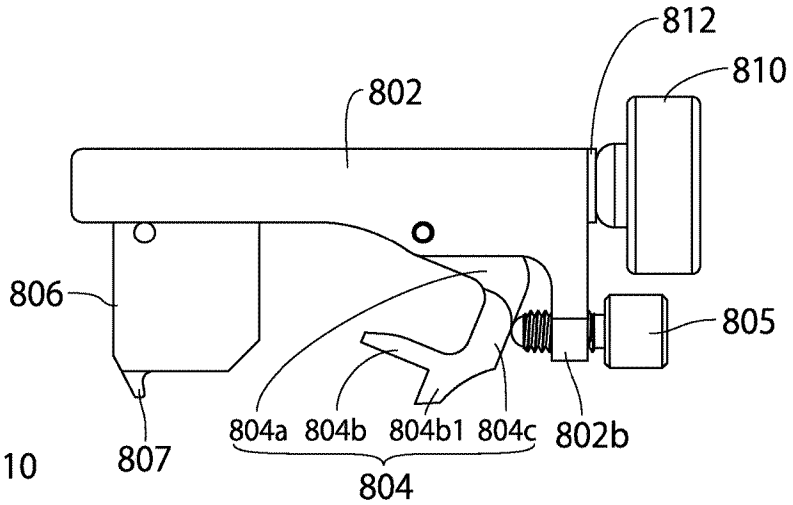
FIG. 8B shows a side view of the intonation tool of the present invention.
Figure 8C:
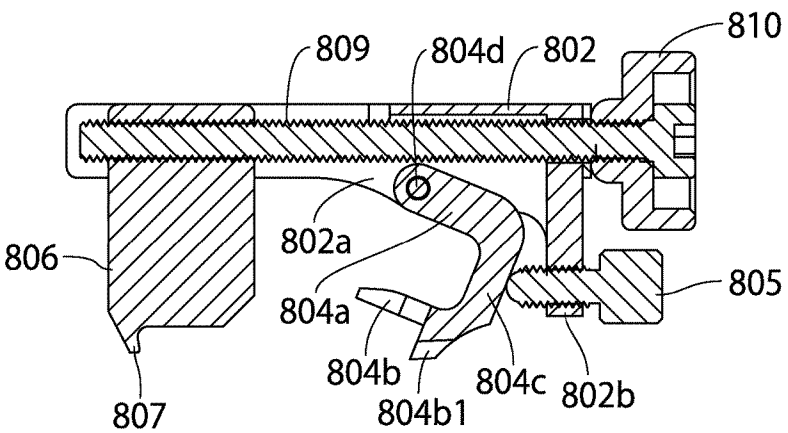
FIG. 8C shows a cross-sectional view of the intonation tool of the present invention.
Figure 8A:
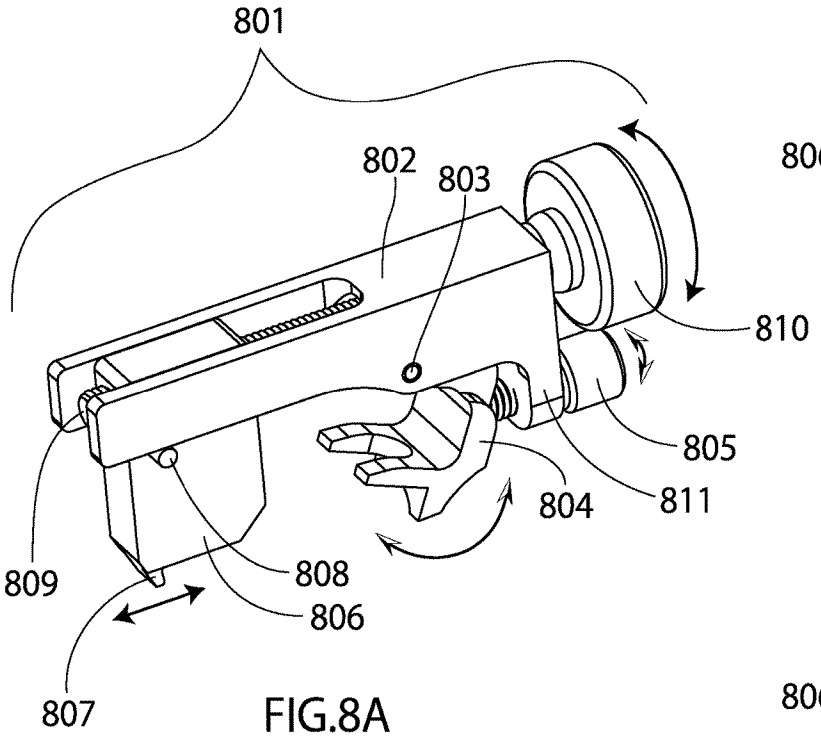
FIG. 8A shows a perspective view of the intonation tool of the present invention.

FIG. 8A is a perspective view of the intonation tool of the present invention. FIG. 8B is a side view of the intonation tool of the present invention. FIG. 8C is a cross-sectional view of the intonation tool of the present invention.

Hereafter, for the convenience of the explanation, when the intonation tool 801 is attached to the fine tuning bridges 701, 702, the direction approaching the strings 106 is referred to as front and the direction separating from the strings 106 (opposite side of the strings 106) is referred to as rear. In addition, the direction approaching the front face of the body 101 is referred to as bottom and the direction separating from the front face of the body 101 is referred to as top. Furthermore, the lower direction of the body 101 when playing the electric guitar is referred to as the right and the upper side of the electric guitar is referred to as left.

The base part 802 is integrally formed at the rear side while the front side of the base part 802 has a branched shape to be separated into right and left. A slider 806 is arranged between two separated portions of the branched shape. The slider 806 is threadedly engaged with an adjustment screw 809 which penetrates through the integrally formed portion located at the rear side of the base part 802. Since the slider 806 is sandwiched by two separated portions of the branched shape of the base part 802, the slider 806 is not relatively rotatable with respect to the base part 802. However, the slider 806 is slidable in the front-rear direction. Accordingly, when the adjustment screw 809 is rotated with respect to the base part 802, the slider 806 which is threadedly engaged with the adjustment screw 809 is moved in the front-rear direction.

A hook 807 is formed in a hook shape to be projected bottomward is formed on the bottom end of the front side of the slider 806. The hook 807 is capable of being engaged with the main saddle 302 of the saddle unit 401. When the hook 807 is engaged with the main saddle 302 and then the adjustment screw 809 is rotated via a knob 810, the slider 806 located at the front end moves the main saddle 302 in the front-rear direction simultaneously with the slider 806.

On the other hand, the base part 802 is engaged with the fine tuning bridges 701, 702 to support the tension of the strings applied to the slider 806. A leg part 804 is rotatably fixed to the base part 802. The base part 802 is capable of being engaged with the rear end of the fine tuning bridges 701, 702.

As shown in FIG. 8C, the leg part 804 has a U-shape integrally formed by an upper beam part 804*a*, a lower beam part 804*b*, and a connecting beam part 804*c*. The connecting beam part 804*c* connects the upper beam part 804*a* with the lower beam part 804*b* at the rear end of the leg part 804. The upper beam part 804*a* is rotatably supported by the base part 802 at the front end of the upper beam part 804*a*. The front end of the upper beam part 804*a* corresponds to a strings side portion. Since a rotation axis 804*d* penetrates through the base part 802 in the left-right direction, a rotation surface of the leg part 804 is in parallel with the lateral surface of the base part 802. A recessed part 802*a* is formed on the bottom face of the base part 802. The recessed part 802*a* is opened bottomward so that the upper beam part 804*a* is inserted in the recessed part 802*a* to be rotatable.

A lock piece part 804*b*1 is formed on the rear end of the lower beam part 804*b* so as to extend bottomward. The lock piece part 804*b*1 is substantially in contact with the rear end of the fine tuning bridges 701, 702. The upper beam part 804*a* and the lower beam part 804*b* are located respectively on the top end and the bottom end of the connecting beam part 804*c* so as to project frontward. The lock piece part 804*b*1 is pressed to the rear end of the fine tuning bridges 701, 702. At that time, a knob part 307*a* of fine tuning screws 307 arranged near the rear end of the fine tuning bridges 701, 702 is positioned between the upper beam part 804*a* and the lower beam part 804*b*. In addition, the front end of the lower beam part 804*b* is entered between the knob part 307*a* of the fine tuning screws 307 and the top surface of the fine tuning bridges 701, 702. Thus, the front end of the lower beam part 804*b* has a branched shape to be separated into right and left to avoid interference with the fine tuning screws 307.

As explained above, the shapes of the rear end of the fine tuning bridges 701, 702 are different between the fine tuning bridge 701 and the fine tuning bridge 702 and the difference is mainly the inclination angle. The leg part 804 is rotatably connected with the base part 802 at the front end of the upper beam part 804*a* so as to be hung down from the base part 802. Thus, the lower beam part 804*b* and the lock piece part 804*b*1 are, via the connecting beam part 804*c*, rotatable and movable from the bottom side to the front side. The rear end of the fine tuning bridges 701 is nearly parallel with the body 101 of the electric guitar. The rear end of the fine tuning bridge 702 is inclined to gradually approach to the body 101 of the electric guitar. When the lower beam part 804*b* and the lock piece part 804*b*1 are rotated and moved from the bottom side to the front side, the angle of the lower beam part 804*b* and the lock piece part 804*b*1 can be coincided with the angle of the rear end of the fine tuning bridges 701, 702. Namely, since the lock piece part 804*b*1 is configured to be rotatable from the bottom side to the front side, the engagement is enabled regardless of the inclination angle of the fine tuning bridges.

On the other hand, a thread-engaging part 802*b* is extended downward from the rear end of the base part 802 so as to be located at the rear side of the connecting beam part 804*c*. Thus, the base part 802 has an approximately reversed L-shaped in a side view.

Figure 9A:
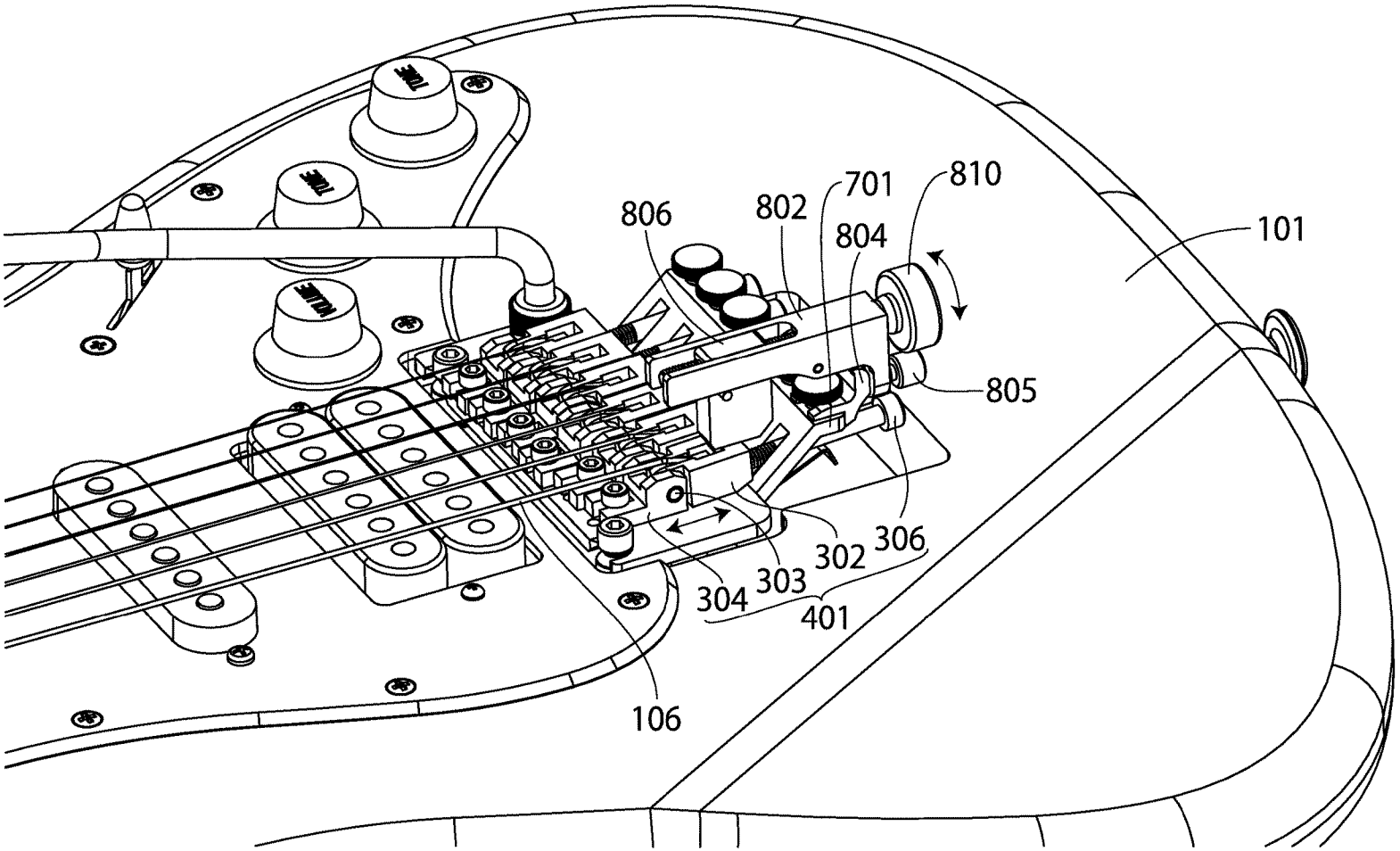
FIG. 9A shows an enlarged perspective view of the body part where the intonation tool of the present invention is attached to the fine tuning bridge of the first type.

FIG. 9A is an enlarged perspective view of the body part where the intonation tool of the present invention is attached to the fine tuning bridge of the first type.

An angle adjustment screw 805 is threadedly engaged with the thread-engaging part 802*b* penetrating in the front-rear direction. The axial center of the angle adjustment screw 805 is aligned with the front-rear direction. The front end of the angle adjustment screw 805 penetrates through the thread-engaging part 802*b* of the base part 802 and is capable of being in contact with the rear face of the connecting beam part 804*c*. When the front end of the angle adjustment screw 805 is positioned in the rearmost position, the connecting beam part 804*c* is approximately vertical. The above described position is a state suitable for being attached to the fine tuning bridge 701 which is in parallel with the body 101 of the electric guitar.

Figure 9B:
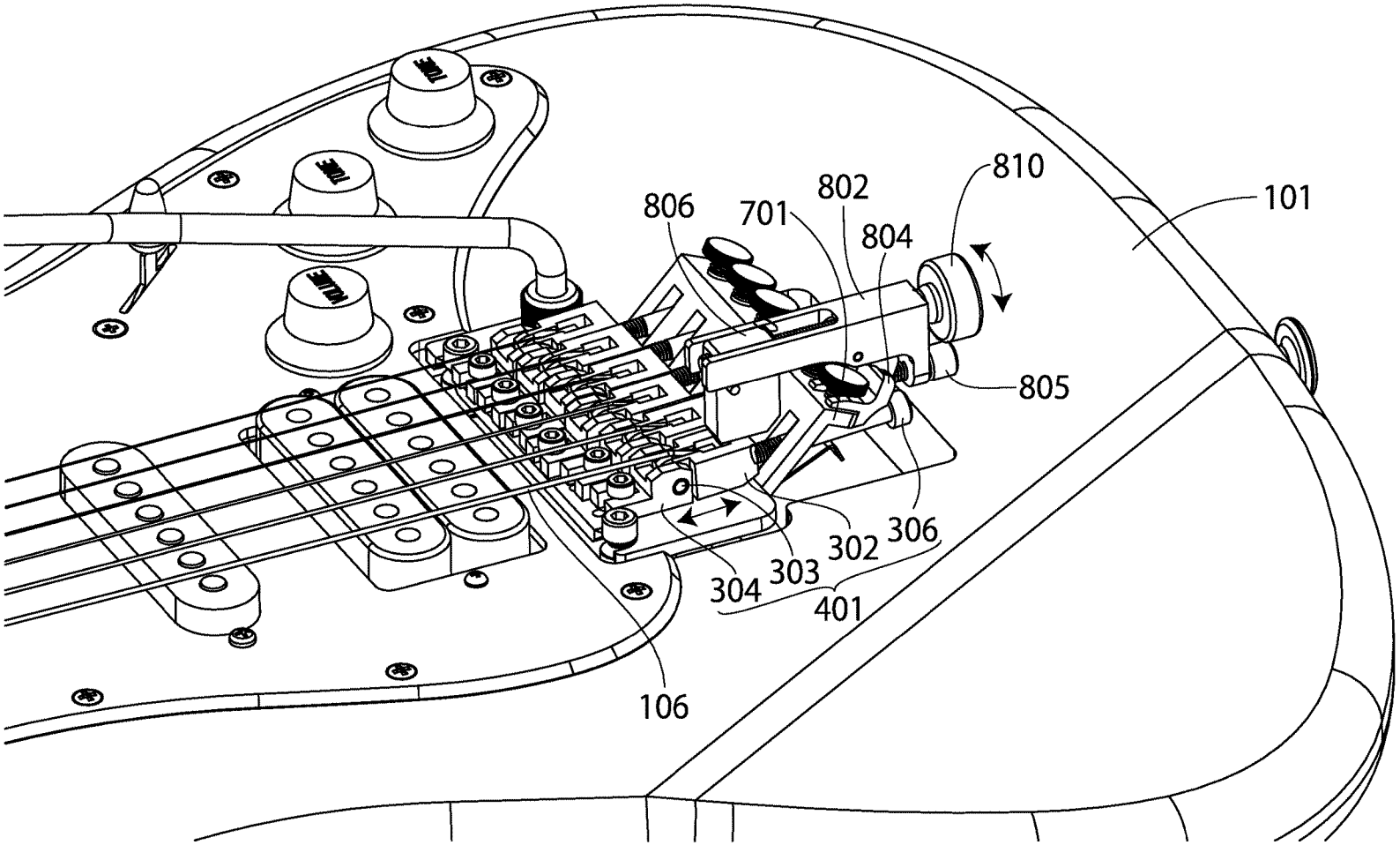
FIG. 9B shows an enlarged perspective view of the body part where the intonation tool of the present invention is attached to the fine tuning bridge of the second type.

FIG. 9B is an enlarged perspective view of the body part where the intonation tool of the present invention is attached to the fine tuning bridge of the second type.

When the angle adjustment screw 805 is rotated and the front end of the angle adjustment screw 805 is gradually moved frontward, the angle adjustment screw 805 pushes the rear face of the connecting beam part 804*c* frontward. Thus, the connecting beam part 804*c* is moved frontward while being moved bottomward. Consequently, the upper beam part 804*a* and the lower beam part 804*b* are rotated together with the connecting beam part 804*c*. When the leg part 804 is gradually rotated, the lower beam part 804*b* is gradually inclined approaching the body 101 of the electric guitar. When the leg part 804 is rotated at a predetermined angle, the intonation tool is suitable for being attached to the fine tuning bridge 702 which is inclined with respect to the body 101 of the electric guitar.

As explained above, in the present invention, the leg part 804 is formed separately from the base part 802 which supports the slider 806. In addition, the inclined state of the leg part 804 can be changed by the angle adjustment screw 805 which penetrates through the thread-engaging part 802*b* of the base part 802.

Consequently, the intonation adjustment is possible both for the fine tuning bridges 701, 702 having different shapes by one intonation tool.

As explained above, the intonation tool of the present invention includes a slider 806 which is capable of being locked to a main saddle 302 of the fine tuning bridges 701,

702; a base part 802 which is threadedly engaged with the slider 806 by a bolt/nut mechanism 802*b*, 805 and slidably supports the slider 806 so as to pull the slider 806 to an opposite side of strings 106; and a leg part 804 which is capable of being locked to the fine tuning bridges 701, 702 at the opposite side of the strings 106 with respect to the main saddle 302 and is supported by the base part 802 so as to be capable of changing an angle with respect to the base part 802.

Namely, the leg part 804 is formed separately from the base part 802, and the leg part 804 is rotatably supported by the base part 802. As an example, the inclination angle of the leg part 804 can be changed by the bolt/nut mechanism formed by the angle adjustment screw 805 which penetrates through the thread-engaging part 802*b* of the base part 802.

The bolt/nut mechanism which is arranged on the base part 802 at an opposite side of the strings 106 with respect to the leg part 804 corresponds to an angle adjustment mechanism. The leg part 804 can be pushed toward a direction approaching the strings 106 by the angle adjustment screw 805.

Consequently, the intonation adjustment is possible both for the fine tuning bridges 701, 702 having different shapes by one intonation tool.

What is claimed is:

1. An intonation tool for a fine tuning bridge, comprising:

a slider which is capable of being locked to a main saddle of the fine tuning bridge;

a base part which is threadedly engaged with the slider by a bolt/nut mechanism and slidably supports the slider so as to pull the slider to an opposite side of strings; and a leg part which is capable of being locked to the fine tuning bridge at the opposite side of the strings with respect to the main saddle and is supported by the base part so as to be capable of changing an angle with respect to the base part, wherein the leg part is rotatably supported by the base part so as to be capable changing the angle with respect to the base part by an angle adjustment mechanism.

2. The intonation tool according to claim 1, wherein the angle adjustment mechanism has an angle adjustment screw which pushes the leg part toward a direction approaching the strings by the bolt/nut mechanism arranged at the opposite side of the strings with respect to the leg part.

3. The intonation tool according to claim 2, wherein the leg part has a U-shape by an upper beam part, a connecting beam part and a lower beam part, the leg part is rotatably supported by the base part at a strings side portion of the upper beam part so that an opening of the leg part is directed to the direction approaching the strings, and the connecting beam part is capable of being pushed toward the direction approaching the strings by the bolt/nut mechanism.

* * * * *